US007328935B1

(12) United States Patent
Tarin

(10) Patent No.: US 7,328,935 B1
(45) Date of Patent: Feb. 12, 2008

(54) TRAILER CANOPY SYSTEM

(76) Inventor: Robert Tarin, 123 Alexander St., San Fernando, CA (US) 91340

( * ) Notice: Subject to any disclaimer, the term of this patent is extended or adjusted under 35 U.S.C. 154(b) by 37 days.

(21) Appl. No.: 11/507,057

(22) Filed: Aug. 21, 2006

(51) Int. Cl.
*E04H 15/08* (2006.01)

(52) U.S. Cl. ..... 296/163; 135/88.12; 160/72

(58) Field of Classification Search ..... 296/163, 296/98, 100.11–100.14, 107.05; 135/88.01, 135/88.03, 88.05, 88.1, 88.07, 88.11, 88.12; 160/66, 72; 52/11
See application file for complete search history.

(56) References Cited

U.S. PATENT DOCUMENTS 2,741,195 A * 4/1956 Hartzner ..... 52/66
3,720,438 A * 3/1973 Johnson et al. ..... 135/88.1
4,465,316 A * 8/1984 Roisen ..... 296/161
4,658,871 A * 4/1987 Gendey et al. ..... 141/293
4,733,683 A * 3/1988 Pozzi ..... 160/22
4,862,940 A * 9/1989 Atchison ..... 160/67
5,423,506 A * 6/1995 Spoon ..... 248/273
5,531,239 A * 7/1996 Hannah, Jr. ..... 135/88.1
5,558,145 A * 9/1996 Baka ..... 160/67
5,566,918 A * 10/1996 Becker ..... 248/351
5,660,425 A * 8/1997 Weber ..... 296/163
6,056,350 A * 5/2000 Brutsaert ..... 296/163
6,131,990 A * 10/2000 Crean ..... 296/163
6,260,908 B1 * 7/2001 Fraula et al. ..... 296/163
6,260,909 B1 * 7/2001 Crean et al. ..... 296/163
RE37,567 E * 3/2002 Murray ..... 296/163
6,598,612 B1 * 7/2003 Crowe ..... 135/88.12
6,981,734 B2 * 1/2006 Martin ..... 296/100.12
7,017,976 B1 * 3/2006 Rutherford et al. ..... 296/163
7,056,890 B2 * 6/2006 Najarian ..... 514/23
7,156,451 B2 * 1/2007 Verhelst ..... 296/163
7,178,536 B2 * 2/2007 Holtkamp ..... 135/88.13
7,188,889 B2 * 3/2007 Wagner et al. ..... 296/163

* cited by examiner

*Primary Examiner*—D. Glenn Dayoan
*Assistant Examiner*—Greg Blankenship

(57) ABSTRACT

A trailer canopy system for providing an area adjacent a trailer that is protected from inclement weather includes a canopy that is extendable from a side of a trailer. The canopy protects an area under the canopy from inclement weather when the canopy is extended from the trailer. A support bar is coupled to a free edge of the canopy positioned opposite of the trailer. Each of a pair of bracing assemblies is pivotally coupled to each of the support bar and the trailer. Each of the bracing assemblies pivots between a stored position and a deployed position. The stored position is defined when each of the bracing assemblies is positioned adjacent the side of the trailer. The deployed positioned is defined when each of the bracing assemblies extends away from the trailer and supports the support bar and the canopy over a ground surface.

20 Claims, 7 Drawing Sheets

TRAILER CANOPY SYSTEM

BACKGROUND OF THE INVENTION

1. Field of the Invention

The present invention relates to trailer awnings and more particularly pertains to a new trailer awning for providing an area adjacent a trailer to be protected from inclement weather.

2. Description of the Prior Art

The use of trailer awnings is known in the prior art. The prior art commonly teaches the use of separate arms to support a canopy in an extended position from a trailer.

While these devices fulfill their respective, particular objectives and requirements, the need remains for a system that has certain improved features that facilitate deployment of a canopy from a trailer. Additionally, the system should include a plurality of gutters to be used with the canopy to direct moisture draining off of the canopy to a desired location.

SUMMARY OF THE INVENTION

The present invention meets the needs presented above by generally comprising a canopy that is extendable from a side of a trailer. The canopy protects an area under the canopy from inclement weather when the canopy is extended from the trailer. A support bar is coupled to a free edge of the canopy positioned opposite of the trailer. Each of a pair of bracing assemblies is pivotally coupled to each of the support bar and the trailer. Each of the bracing assemblies pivots between a stored position and a deployed position. The stored position is defined by each of the bracing assemblies being positioned adjacent the side of the trailer. The deployed positioned is defined by each of the bracing assemblies extending away from the trailer and supporting the support bar and the canopy over a ground surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
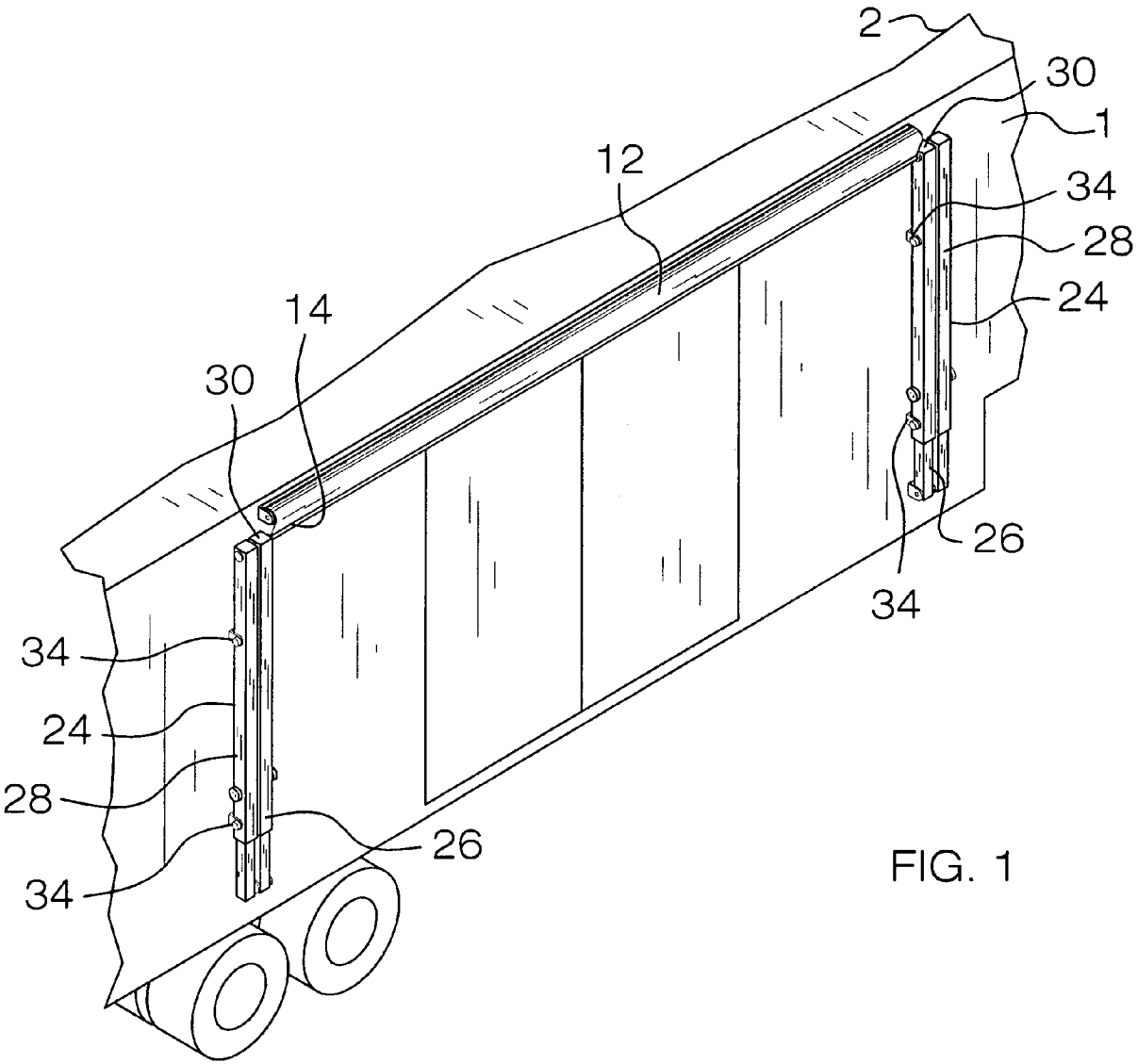
FIG. 1 is a perspective view of a trailer canopy system according to the present invention with the bracing assemblies in the stored position.
Figure 2:
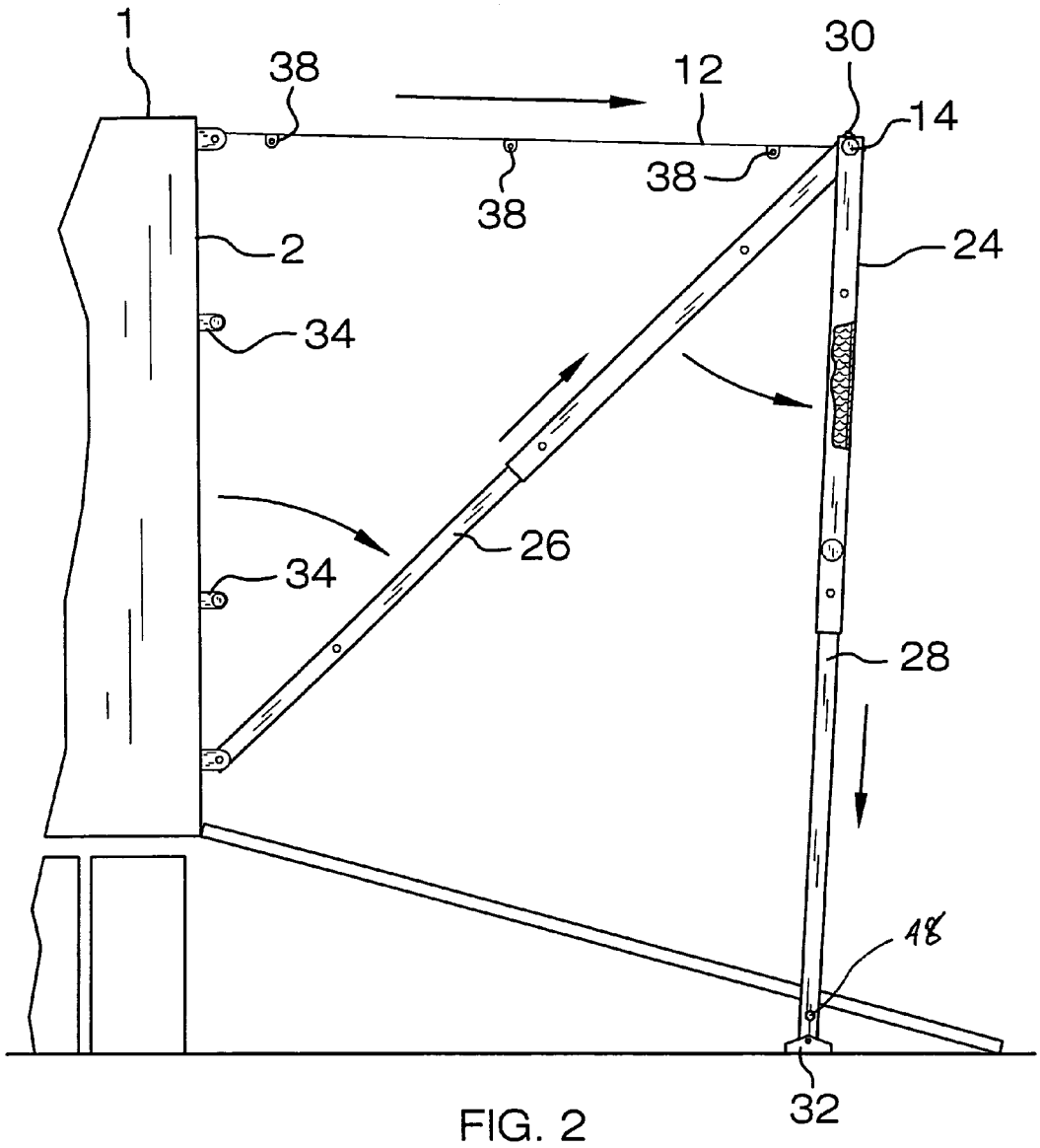
FIG. 2 is a side view of the present invention with the bracing assemblies in the deployed position.
Figure 3:
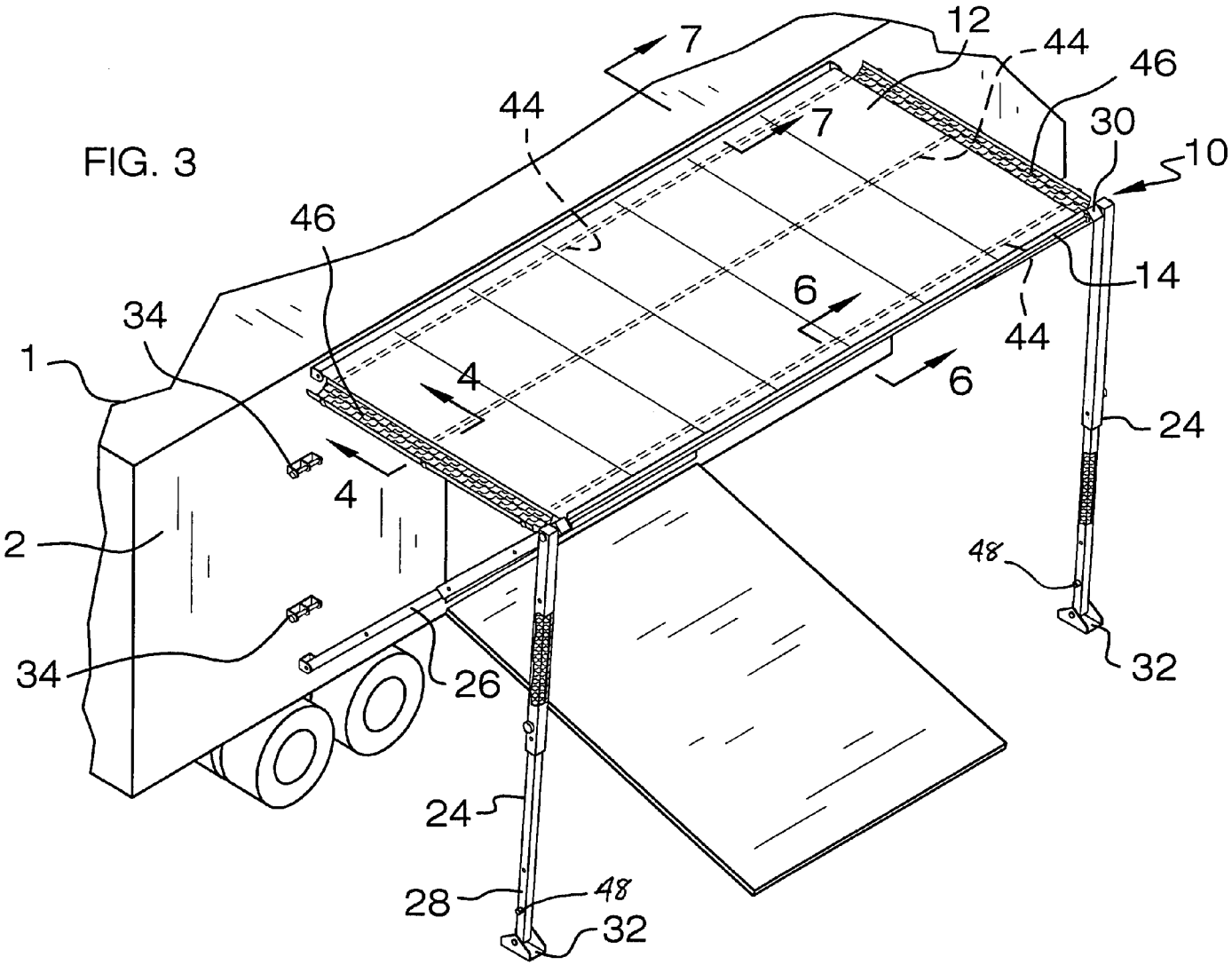
FIG. 3 is a perspective view of the present invention.
Figure 4:
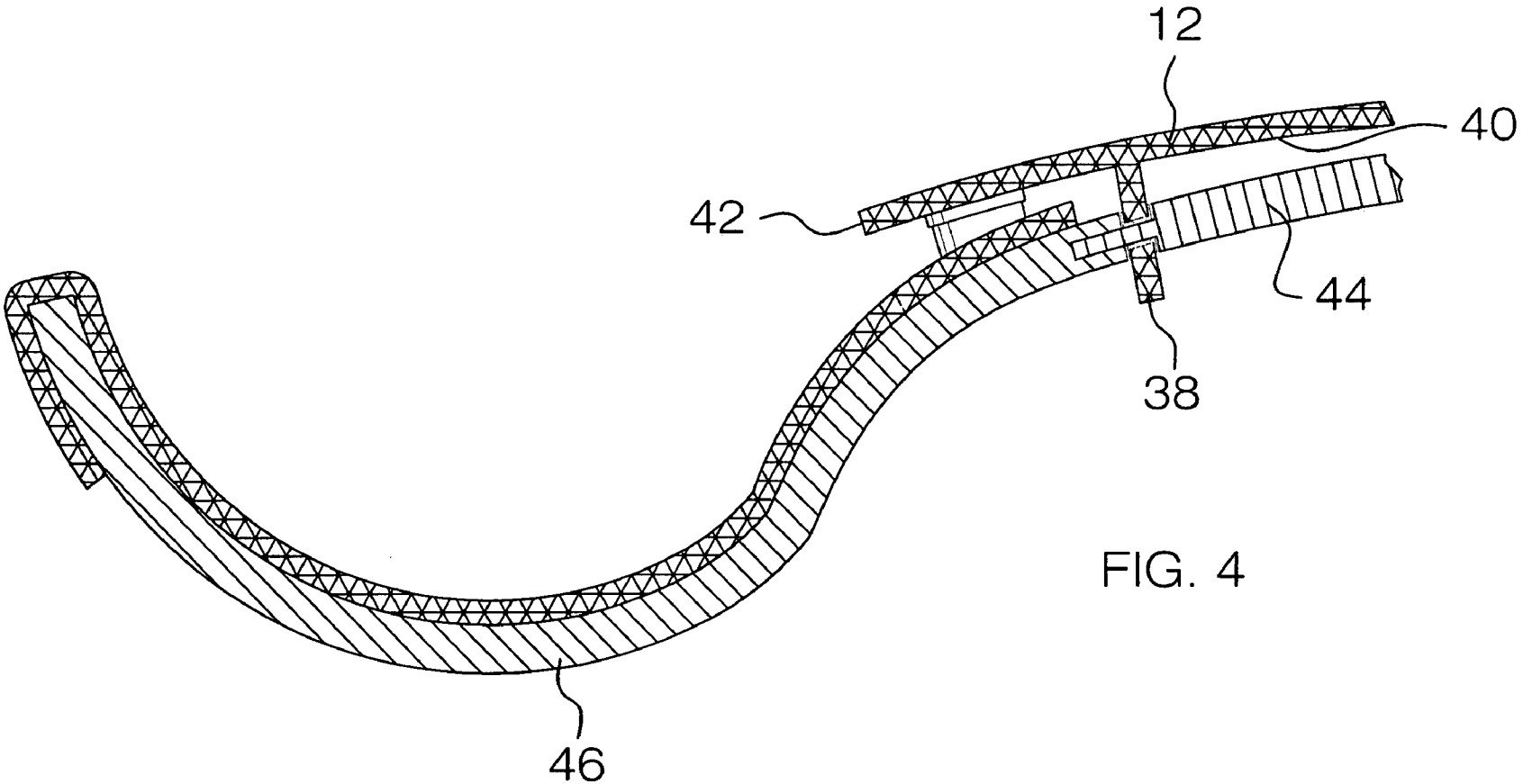
FIG. 4 is a cross-sectional view of the present invention taken along line 4-4 of FIG. 3.
Figure 5:
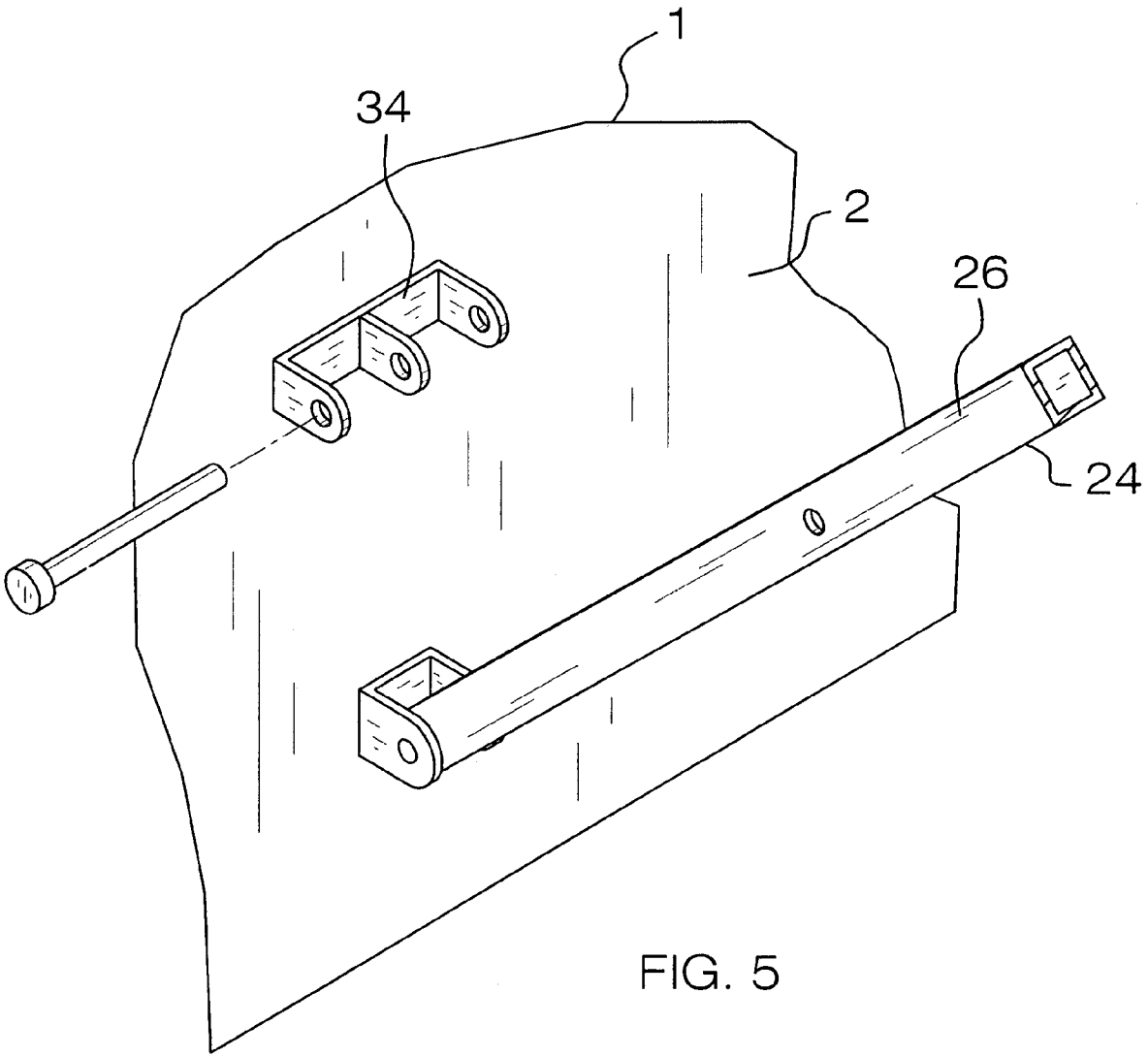
FIG. 5 is an enlarge perspective view of the bracket and the extension arm of the present invention.
Figure 6:
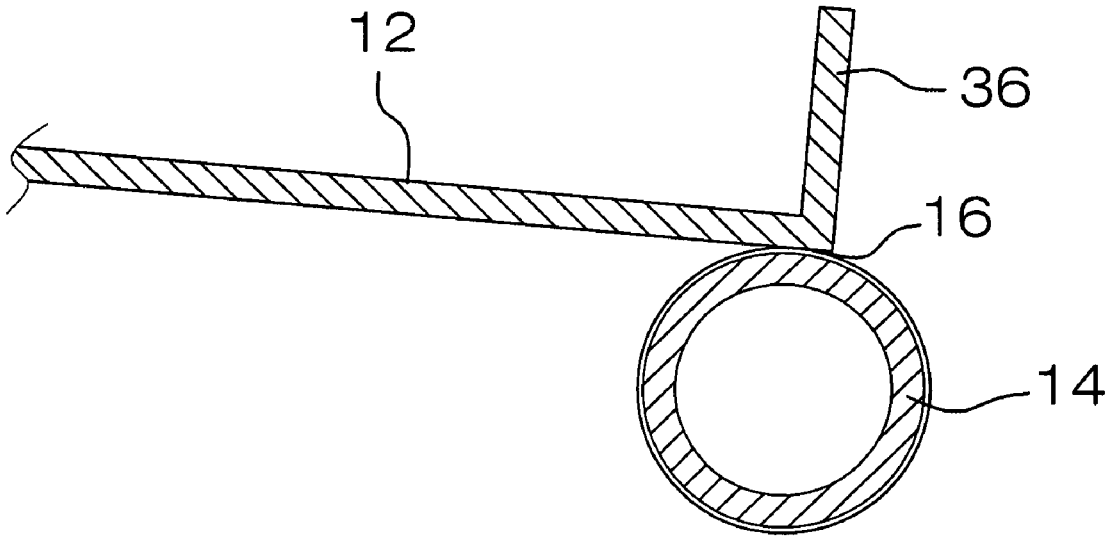
FIG. 6 is a cross-sectional view of the present invention taken along line 6-6 of FIG. 3.
Figure 7:
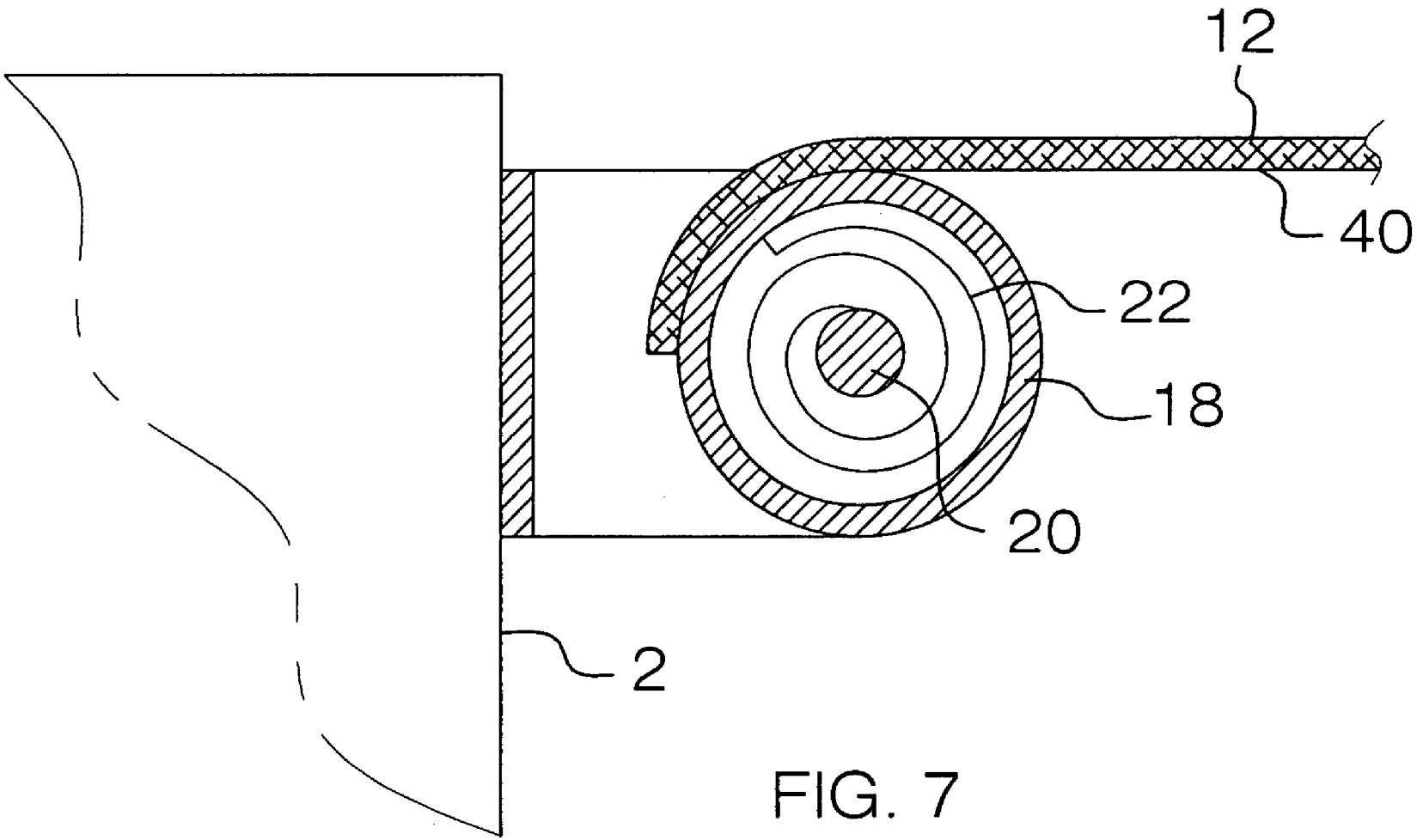
FIG. 7 is a cross-sectional view of the present invention taken along line 7-7 of FIG. 3.

With reference now to the drawings, and in particular to FIGS. 1 through 7 thereof, a new trailer awning embodying the principles and concepts of the present invention and generally designated by the reference numeral 10 will be described.

As best illustrated in FIGS. 1 through 7, the trailer canopy system 10 generally comprises a canopy 12 being extendable from a side 1 of a trailer 2. The canopy 12 protects an area under the canopy 12 from inclement weather when the canopy 12 is extended from the trailer 2. A support bar 14 is coupled to a free edge 16 of the canopy 12 positioned opposite of the trailer 2. A reel bar 18 is coupled to the canopy 12 opposite the support bar 14 and is rotatable around a reel axle 20. A biasing member 22 is coupled between the reel axle 20 and the reel bar 18 to rotate the reel bar 18 about the reel axle 20, thereby winding the canopy 12 onto the reel bar 18 when the canopy 12 is not extended from the trailer 2.

Each of a pair of bracing assemblies 24 is pivotally coupled to each of the support bar 1-4 and the trailer 2. Each of the bracing assemblies 24 pivots between a stored position and a deployed positioned. The stored position is defined by each of the bracing assemblies 24 being positioned adjacent the side 1 of the trailer 2. The deployed positioned is defined by each of the bracing assemblies 24 extending away from the trailer 2 and supporting the support bar 14 and the canopy 12 over a ground surface.

Each of the bracing assemblies 24 includes an extension arm 26 pivotally coupled to the side 1 of the trailer 2 and pivotally coupled to the support bar 14. The extension arm 26 is telescopic to adjust a length of the extension arm 26 to change an angle of the canopy 12 with respect to the side 1 of the trailer 2 when the canopy 12 is extended from the trailer 2. A stanchion arm 28 is rotatably coupled to the support bar 14 and positioned adjacent a distal end 30 of the extension arm 26 opposite the trailer 2. The stanchion arm 28 is telescopic to permit adjustment of a length of the stanchion arm 28. The stanchion arm 28 extends between the support bar 14 and the ground surface to support the free edge 16 of the canopy 12 a desired distance above the ground surface. A foot plate 32 is pivotally coupled to the stanchion arm 28 opposite the support bar 14. The foot plate 32 abuts the ground surface.

Each of a plurality of brackets 34 is mounted to the side 1 of the trailer 2. Each of the brackets 34 engages one of the bracing assemblies 24 and secures the bracing assemblies 24 to the trailer 2 when the bracing assemblies 24 are in the stored positioned. A lip 36 is integrally coupled to the canopy 12 and is coextensive with the free edge 16 of the canopy 12. The lip 36 extends upwardly from the canopy 12. The lip 36 inhibits moisture gathered on the canopy 12 from running over the free end of the canopy 12.

A plurality of clips 38 is arranged into a pair of sets of clips 38. Each set of clips 38 is coupled to a bottom surface 40 of the canopy 12 and positioned adjacent one of a pair of side edges 42 of the canopy 12 so that each of the side edges 42 has two of the clips positioned thereon. Each of a plurality of ribs 44 releasably engages one of the clips 38 of each of the sets of clips 38 and extends across the canopy 12.

Each of the ribs 44 is positioned parallel to the support bar 14 and has an arcuate configuration. The ribs 44 upwardly bow the canopy 12 to direct moisture gathering on the canopy 12 towards the side edges 42 of the canopy 12.

Each of a pair of gutters 46 releasably engages a portion of each of the ribs 44 extending through the clips 38 and is releasably secured to the canopy 12 adjacent an associated one of the side edges 42 of the canopy 12. Each of the gutters 46 is concave and extends under the associated one of the side edges 42 of the canopy 12. The gutters 46 extend between the support bar 14 and the trailer 2 to collect the moisture draining over the side edges 42 and direct the moisture toward the support bar 14 and the trailer 2. The gutters 46 may drain into the stanchion arm 28 of an associated one of the bracing assemblies 26 to facilitate keeping the area under the canopy 12 drier as well as providing additionally weight to the stanchion arm 28 for greater stability. Each of the bracing assemblies 26 includes a drain pin 48 being insertable into the stanchion arm 28 opposite the support bar 14. The drain pin 48 inhibits the moisture drained into the stanchion arm 28 from the gutters 46 from draining from the stanchion arm 28 when the drain pin 48 is inserted into the stanchion arm 28.

In use, the bracing assemblies 24 are pivoted from the stored position to the deployed position to extend the canopy 12 from the trailer 2. The extension arm 26 and the stanchion arm 28 of each of the bracing assemblies 24 are lengthened to the desired lengths to position the canopy 12 the desired distance from the ground surface. The ribs 44 are extended between and engaged to the clips 38 to bow the canopy 12. The gutters 46 are engaged to the portion of the ribs 44 extending through the clips 38 and engaged to the canopy 12 to collect the moisture draining from the canopy 12 over the side edges 42.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A trailer canopy system for providing protection from inclement weather adjacent to a side of a trailer, said system comprising:

a canopy being extendable from the side of the trailer, said canopy protecting an area under said canopy from inclement weather when said canopy is extended from the trailer;

a support bar being coupled to a free edge of said canopy positioned opposite of said trailer;

a pair of bracing assemblies, each of said bracing assemblies being pivotally coupled to each of said support bar and the trailer, each of said bracing assemblies pivoting between a stored position and a deployed position, said stored position being defined by each of said bracing assemblies being positioned adjacent the side of the trailer, said deployed positioned being defined by each of said bracing assemblies extending away from the trailer and supporting said support bar and said canopy over a ground surface; and a lip being integrally coupled to said canopy and being coextensive with said free edge of said canopy, said lip extending upwardly from said canopy, said lip inhibiting moisture gathered on said canopy from running over said free end of said canopy.

2. The system according to claim 1, wherein each of said bracing assemblies includes an extension arm pivotally coupled to the side of the trailer and pivotally coupled to said support bar.

3. The system according to claim 2, wherein said extension arm is telescopic to adjust a length of said extension arm.

4. The system according to claim 2, wherein each of said bracing assemblies includes a stanchion arm rotatably coupled to said support bar and positioned adjacent a distal end of said extension arm opposite the trailer, said stanchion arm extending between said support bar and the ground surface to support said free edge of said canopy a desired distance above the ground surface.

5. The system according to claim 4, wherein said stanchion arm is telescopic to permit adjustment of a length of said stanchion arm.

6. The system according to claim 4, wherein each of said bracing assemblies includes a foot plate pivotally coupled to said stanchion arm opposite said support bar, said foot plate abutting the ground surface.

7. The system according to claim 6, further comprising a plurality of brackets, each of said brackets being mounted to the side of the trailer, each of said brackets engaging one of said bracing assemblies and securing said bracing assemblies to the trailer when said bracing assemblies are in the stored positioned.

8. The system according to claim 1, further comprising a plurality of clips, said clips being arranged into a pair of sets of clips, each set of clips being coupled to a bottom surface of said canopy and positioned adjacent one of a pair of side edges of said canopy.

9. The system according to claim 8, further comprising a plurality of ribs, each of said ribs releasably engaging one of said clips of each of said sets of clips and extending across said canopy.

10. The system according to claim 9, wherein each of said ribs is positioned parallel to said support bar and has an arcuate configuration, said ribs upwardly bowing said canopy to direct moisture gathering on said canopy towards said side edges of said canopy.

11. The system according to claim 9, further comprising a pair of gutters, each of said gutters releasably engaging a portion of each of said ribs extending through said clips and being releasably secured to said canopy adjacent an associated one of said side edges of said canopy.

12. The system according to claim 11, wherein each of said bracing assemblies includes each of said gutters being concave and extending under the associated one of said side edges of said canopy, said gutters extending between said support bar and the trailer to collect the moisture draining over said side edges and direct the moisture toward said support bar and the trailer.

13. A trailer canopy system for providing protection from inclement weather adjacent to a side of a trailer, said system comprising:

a canopy being extendable from the side of the trailer, said canopy protecting an area under said canopy from inclement weather when said canopy is extended from the trailer;

a support bar being coupled to a free edge of said canopy positioned opposite of said trailer;

a pair of bracing assemblies, each of said bracing assemblies being pivotally coupled to each of said support bar and the trailer, each of said bracing assemblies pivoting between a stored position and a deployed positioned, said stored position being defined by each of said bracing assemblies being positioned adjacent the side of the trailer, said deployed positioned being defined by each of said bracing assemblies extending away from the trailer and supporting said support bar and said canopy over a ground surface, each of said bracing assemblies comprising;

an extension arm being pivotally coupled to the side of the trailer and pivotally coupled to said support bar, said extension arm being telescopic to adjust a length of said extension arm;

a stanchion arm being rotatably coupled to said support bar and positioned adjacent a distal end of said extension arm opposite the trailer, said stanchion arm being telescopic to permit adjustment of a length of said stanchion arm, said stanchion arm extending between said support bar and the ground surface to support said free edge of said canopy a desired distance above the ground surface;

a foot plate being pivotally coupled to said stanchion arm opposite said support bar, said foot plate abutting the ground surface;

a plurality of brackets, each of said brackets being mounted to the side of the trailer, each of said brackets engaging one of said bracing assemblies and securing said bracing assemblies to the trailer when said bracing assemblies are in the stored positioned;

a lip being integrally coupled to said canopy and being coextensive with said free edge of said canopy, said lip extending upwardly from said canopy, said lip inhibiting moisture gathered on said canopy from running over said free end of said canopy;

a plurality of clips, said clips being arranged into a pair of sets of clips, each set of clips being coupled to a bottom surface of said canopy and positioned adjacent one of a pair of side edges of said canopy;

a plurality of ribs, each of said ribs releasably engaging one of said clips of each of said sets of clips and extending across said canopy, each of said ribs being positioned parallel to said support bar and having an arcuate configuration, said ribs upwardly bowing said canopy to direct moisture gathering on said canopy towards said side edges of said canopy; and a pair of gutters, each of said gutters releasably engaging a portion of each of said ribs extending through said clips and being releasably secured to said canopy adjacent an associated one of said side edges of said canopy, each of said gutters being concave and extending under the associated one of said side edges of said canopy, said gutters extending between said support bar and the trailer to collect the moisture draining over said side edges and direct the moisture toward said support bar and the trailer.

14. A trailer canopy system for providing protection from inclement weather adjacent to a side of a trailer, said system comprising:

a canopy being extendable from the side of the trailer, said canopy protecting an area under said canopy from inclement weather when said canopy is extended from the trailer;

a support bar being coupled to a free edge of said canopy positioned opposite of said trailer;

a pair of bracing assemblies, each of said bracing assemblies being pivotally coupled to each of said support bar and the trailer, each of said bracing assemblies pivoting between a stored position and a deployed position, said stored position being defined by each of said bracing assemblies being positioned adjacent the side of the trailer, said deployed positioned being defined by each of said bracing assemblies extending away from the trailer and supporting said support bar and said canopy over a ground surface; and a plurality of clips, said clips being arranged into a pair of sets of clips, each set of clips being coupled to a bottom surface of said canopy and positioned adjacent one of a pair of side edges of said canopy.

15. The system according to claim 14, wherein each of said bracing assemblies includes an extension arm pivotally coupled to the side of the trailer and pivotally coupled to said support bar.

16. The system according to claim 15, wherein each of said bracing assemblies includes a stanchion arm rotatably coupled to said support bar and positioned adjacent a distal end of said extension arm opposite the trailer, said stanchion arm extending between said support bar and the ground surface to support said free edge of said canopy a desired distance above the ground surface.

17. The system according to claim 16, further comprising a plurality of brackets, each of said brackets being mounted to the side of the trailer, each of said brackets engaging one of said bracing assemblies and securing said bracing assemblies to the trailer when said bracing assemblies are in the stored positioned.

18. The system according to claim 14, further comprising a plurality of ribs, each of said ribs releasably engaging one of said clips of each of said sets of clips and extending across said canopy.

19. The system according to claim 18, wherein each of said ribs is positioned parallel to said support bar and has an arcuate configuration, said ribs upwardly bowing said canopy to direct moisture gathering on said canopy towards said side edges of said canopy.

20. The system according to claim 19, further comprising a pair of gutters, each of said gutters releasably engaging a portion of each of said ribs extending through said clips and being releasably secured to said canopy adjacent an associated one of said side edges of said canopy.

* * * * *